US009624876B2

(12) United States Patent
Pursifull

(10) Patent No.: US 9,624,876 B2
(45) Date of Patent: Apr. 18, 2017

(54) METHODS AND SYSTEMS FOR FUEL VAPOR METERING VIA VOLTAGE-DEPENDENT SOLENOID VALVE ON DURATION COMPENSATION

(71) Applicant: Ford Global Technologies, LLC, Dearborn, MI (US)

(72) Inventor: Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 190 days.

(21) Appl. No.: 14/477,629

(22) Filed: Sep. 4, 2014

(65) Prior Publication Data

US 2016/0069303 A1 Mar. 10, 2016

(51) Int. Cl.
*F02M 25/08* (2006.01)
*F02D 41/00* (2006.01)

(52) U.S. Cl.
CPC ..... *F02M 25/0836* (2013.01); *F02D 41/0032* (2013.01); *F02D 41/004* (2013.01); *F02D 41/0042* (2013.01); *F02D 2200/0406* (2013.01); *F02D 2200/703* (2013.01); *F02M 2025/0845* (2013.01)

(58) Field of Classification Search
CPC ..... F02M 25/0836; F02M 25/0854
USPC ..... 123/516–520; 701/102–105
See application file for complete search history.

(56) References Cited

U.S. PATENT DOCUMENTS 5,060,621 A 10/1991 Cook et al.
5,143,118 A * 9/1992 Sule ..... F16K 31/0675 137/554
5,216,998 A 6/1993 Hosoda et al.
5,289,811 A 3/1994 Covert et al.
5,456,238 A 10/1995 Horiuchi et al.
6,092,515 A * 7/2000 Morikawa ..... F02D 41/0032 123/698
6,158,415 A * 12/2000 Ichikawa ..... B60K 5/1283 123/192.1
6,202,632 B1 3/2001 Geiger et al.
6,247,456 B1 * 6/2001 Everingham ..... F02M 25/0836 123/458
6,493,204 B1 * 12/2002 Glidden ..... B60T 8/36 361/154
7,293,552 B2 * 11/2007 Leone ..... F02D 19/0692 123/519
8,681,468 B2 3/2014 Jacob et al.
8,739,766 B2 * 6/2014 Jentz ..... F02N 11/003 123/516
2003/0001346 A1 * 1/2003 Hamilton ..... B60G 17/0152 280/5.515

(Continued)

FOREIGN PATENT DOCUMENTS

KR 101296490 B1 * 8/2013
WO 2007125356 A1 11/2007

OTHER PUBLICATIONS

English translation of KR 101296490 B1.*

*Primary Examiner* — Joseph Dallo
(74) *Attorney, Agent, or Firm* — James Dottavio; McCoy Russell LLP

(57) ABSTRACT

Methods and systems are provided for compensating a pulse width of a signal applied to a solenoid purge valve based on an input voltage, and delays in opening and/or closing the solenoid valve.

20 Claims, 7 Drawing Sheets

(56) References Cited

U.S. PATENT DOCUMENTS

| | | | | |
|---|---|---|---|---|
| 2003/0051716 | A1* | 3/2003 | Esteghlal | F02D 41/0032 123/698 |
| 2004/0045538 | A1* | 3/2004 | Tagami | F02M 25/08 123/520 |
| 2004/0079914 | A1* | 4/2004 | Burrola | F02M 25/0836 251/129.15 |
| 2005/0240336 | A1* | 10/2005 | Reddy | F02D 41/0045 701/103 |
| 2007/0266997 | A1* | 11/2007 | Clontz, Jr. | B01D 53/0438 123/519 |
| 2007/0295313 | A1 | 12/2007 | Amano et al. | |
| 2008/0210207 | A1* | 9/2008 | Boyarski | F02M 25/0228 123/575 |
| 2009/0090106 | A1 | 4/2009 | Muller | |
| 2009/0320790 | A1* | 12/2009 | Lewis | F01N 11/002 123/299 |
| 2010/0012099 | A1* | 1/2010 | Kerns | F02D 41/0042 123/520 |
| 2010/0223984 | A1* | 9/2010 | Pursifull | F02M 25/0836 73/114.39 |
| 2010/0224171 | A1* | 9/2010 | Peters | F02M 25/089 123/520 |
| 2011/0023481 | A1 | 2/2011 | Baeuerle | |
| 2012/0166065 | A1* | 6/2012 | Lewis | F02D 41/0025 701/103 |
| 2012/0260624 | A1 | 10/2012 | Veinbergs | |
| 2013/0032127 | A1* | 2/2013 | Jentz | F02N 11/003 123/520 |

* cited by examiner

CPV INJECTION VOLUME CHARACTERISTICS

METHODS AND SYSTEMS FOR FUEL VAPOR METERING VIA VOLTAGE-DEPENDENT SOLENOID VALVE ON DURATION COMPENSATION

FIELD

The present description relates to systems and methods for operation of pulse width modulated solenoid valves for evaporative fuel vapor canister purging.

BACKGROUND AND SUMMARY

Internal combustion engines may include evaporative fuel recovery systems that have carbon fuel vapor canisters coupled to a fuel tank for absorbing fuel vapors. The canisters are also coupled to an engine intake manifold through an electronically controlled canister purge valve (CPV). Under purge conditions, fuel vapors vented from the fuel tank and captured in the canisters are drawn into the engine, where the vapors are combusted along with fuel injected by fuel injectors. A flow rate of the fuel vapors may be controlled via the CPV. The CPV may be a pulse width modulated solenoid valve that is actuated by pulse width modulated signals that are ON for a fraction of a period of the pulse and OFF for the remainder of the period. The CPV may open to allow fuel vapors to enter the engine during the ON state and may close during the OFF state.

One approach for operating the solenoid valve includes generating the pulse-width-modulated signal by utilizing a voltage supplied by a vehicle battery, and applying the signal to open the solenoid valve. However, the inventors herein have identified issues with such an approach. As an example, a battery state of charge may vary from a fully charged state to a discharged state during vehicle operation. Consequently, fuel vapor flow rate may vary. In particular, during low flow conditions, when the intake manifold vacuum is below a threshold, a high voltage input may result in higher purge flow rates than desired, whereas a low voltage input may result in insufficient purge. Consequently, due to large variation in the battery state of charge, control of purge valve during low intake vacuum conditions may be reduced.

Further, there may be delay in adjusting the valve from a closed state to an open state (herein referred to as opening response time) and/or in adjusting the valve from the open state to the closed state (herein referred to as closing response time). For example, if the opening response time is greater than the closing response time, the purge flow rate may be less than desired, and if the opening response time is less than the closing response time, purge flow rate may be greater than desired. Due to variations in the purge flow rate resulting from variations in the battery state of charge, and the delayed solenoid valve response times, an engine air-to-fuel ratio control may be reduced leading to reduced fuel economy and/or increased emissions.

In one example, the above issues may be at least partly addressed by a method for an engine comprising: during fuel vapor purging, applying a signal to an electronically controllable solenoid valve coupling a fuel vapor canister and an intake manifold of the engine in synchronization with a crankshaft position; wherein, a pulse width of the signal is based on an offset duration determined based on an instantaneous system voltage, an opening response time of the solenoid valve and a closing response time of the solenoid valve.

As an example, when purging conditions are met, a pulse-width modulated signal may be applied to the solenoid valve to open the solenoid for a desired duration to deliver a desired volume of fuel vapors. A pulse width of the signal (that is, a duration of solenoid open state) may be compensated based an offset duration. The offset duration may be determined based on a system voltage to compensate for variation in the system voltage. Further, in order to reduce variations in the purge flow rate due to the solenoid valve response times, the offset duration may be further adjusted based on the opening response time and the closing response time of the valve. Still further, purging of fuel vapors may be synchronized with a cylinder event (e.g. an intake stroke) in order to improve cylinder-to-cylinder distribution of fuel vapors and reduce fueling noise. For example the waveform may have a base frequency equal to cylinder firing frequency of the engine cylinders of the engine.

In this way, by delivering the signal with a pulse-width compensated for voltage variations and valve response times, improved purge flow control in a wide-voltage range may be achieved. Further, applying the signal in synchronization with engine operation may result in improved fuel vapor distribution.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
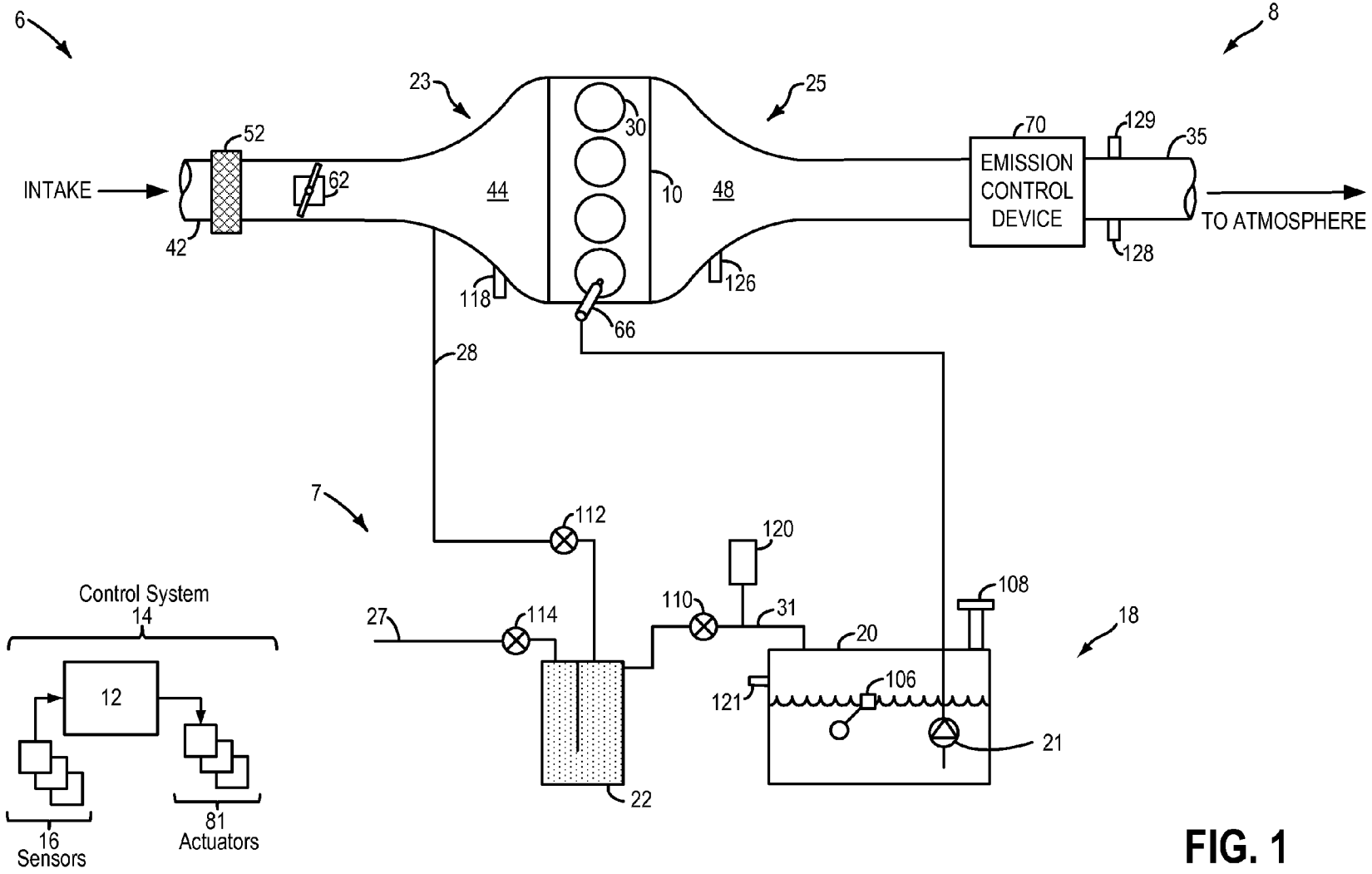
FIG. 1 shows a schematic depiction of an engine and an associated fuel system.
Figure 2:
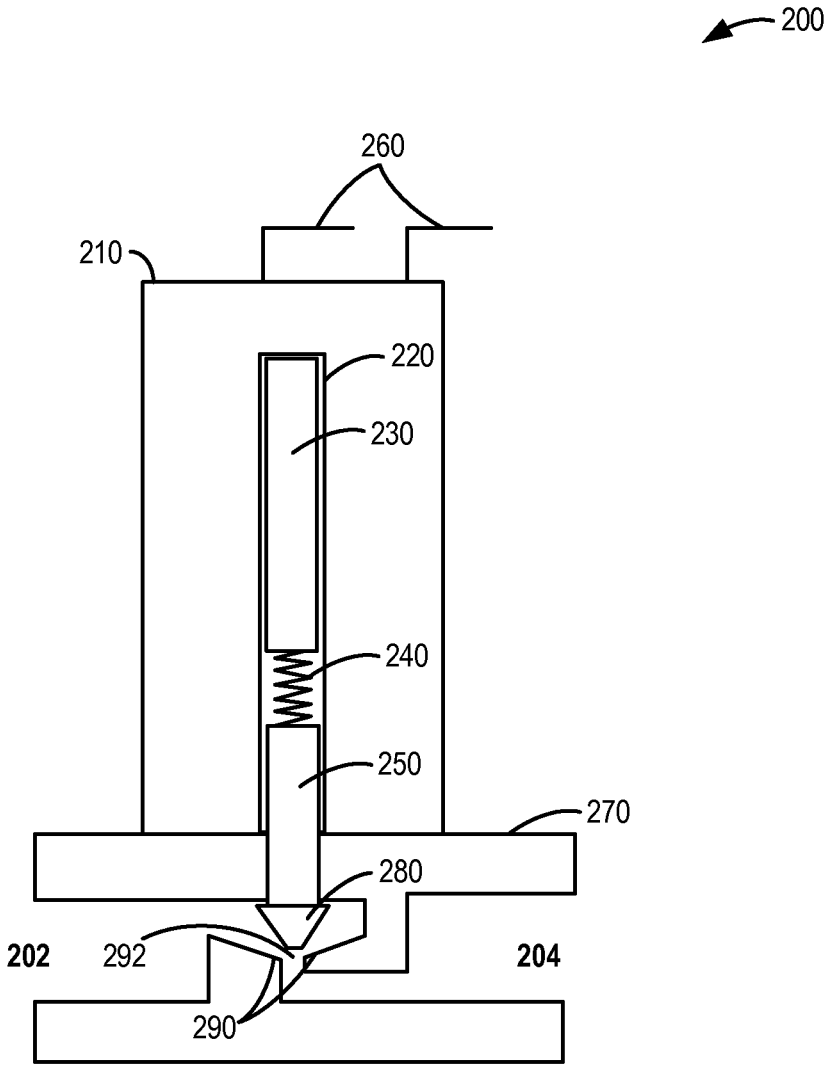
FIG. 2 shows a cross section of a gas solenoid canister purge valve.
Figure 5:
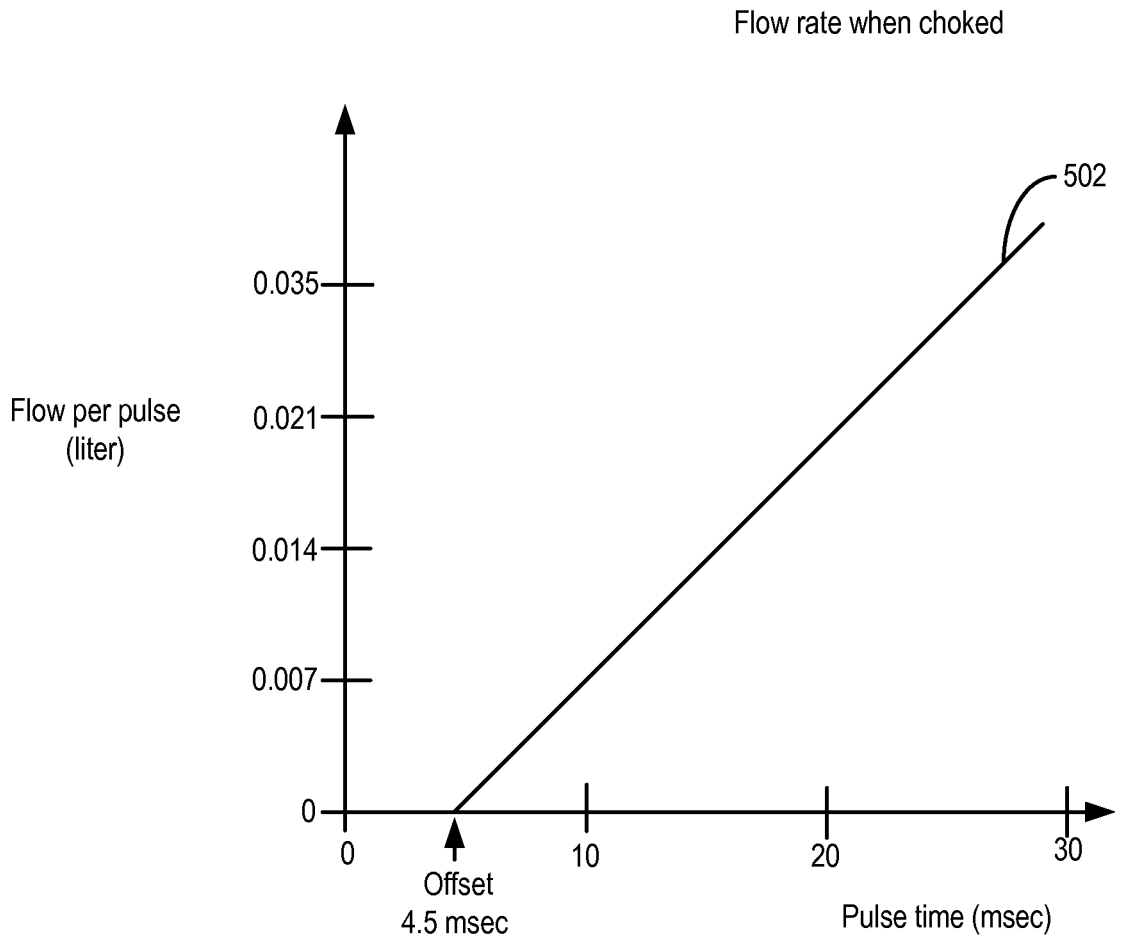
FIG. 5 shows a graph illustrating an example canister purge valve injection volume characteristics.
Figure 6:
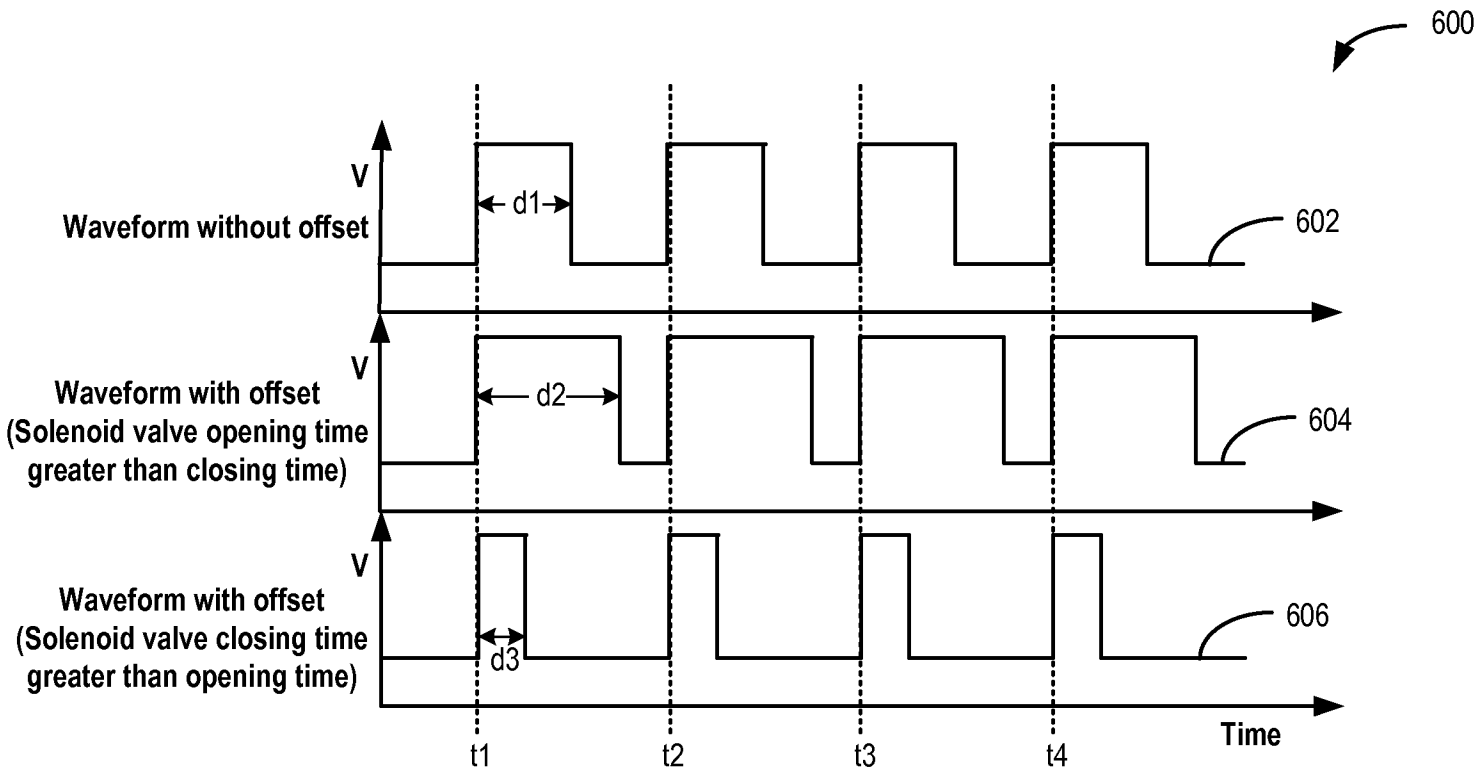
FIG. 6 shows a graph illustrating an example solenoid valve duty cycle.
Figure 7:
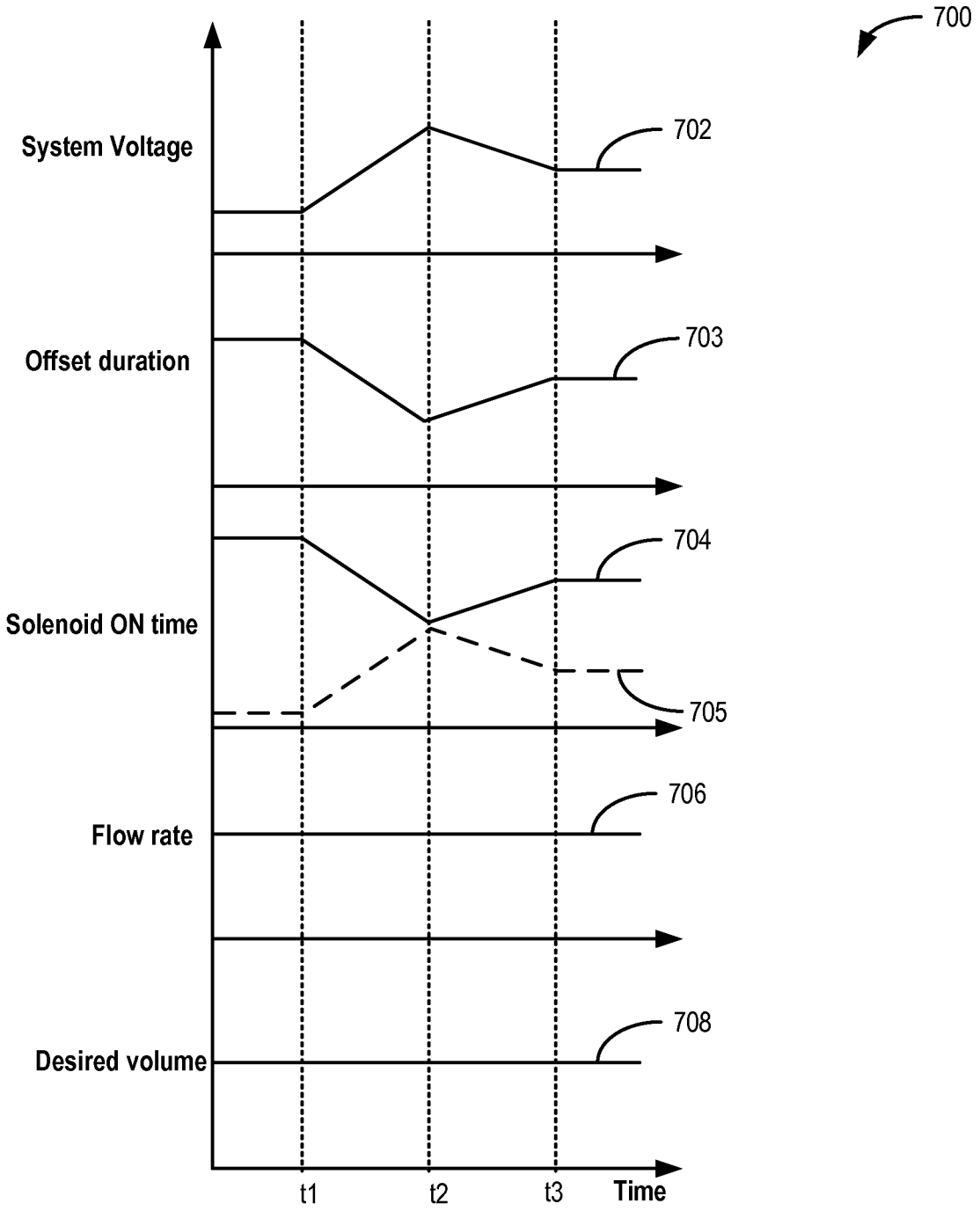
FIG. 7 shows an example adjustment of solenoid ON duration based on a system voltage and solenoid valve response times.

The present description relates to methods and systems for providing a voltage dependent solenoid valve ON duration compensation in a vehicle system, such as a vehicle system of FIG. 1 including a canister purge solenoid valve, such as solenoid valve 200 depicted in FIG. 2. An engine controller may be configured to perform control routines, such as those depicted in FIGS. 3-4 to purge fuel vapors from a fuel vapor canister via the solenoid valve and adjust a duty cycle of a pulse width modulated signal applied to the solenoid valve. The duty cycle of the signal may be adjusted based on an offset compensation factor, which may be determined based on a vehicle system voltage, an opening response time of the valve, and a closing response time of the valve. An example adjustment of the signal based on the opening response time and the closing response time is shown at FIG. 6. An example adjustment of the signal based on the system voltage, and the response times is shown at FIG. 7. The duty cycle may be further adjusted based on a pressure ratio of a pressure downstream of the valve to a pressure upstream of the valve. When the pressure ratio is at or below a threshold ratio, the valve may be operating in sonic conditions. During sonic conditions, vapor flow rate may be constant. An example graph of the canister purge valve injection volume characteristics during sonic conditions is shown at FIG. 5.

Turning to FIG. 1, it shows a schematic depiction of a hybrid vehicle system 6 that can derive propulsion power from engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein.

In some embodiments, engine 10 may be a boosted engine wherein the engine intake includes a boosting device, such as a turbocharger. When included, a turbocharger compressor may be configured to draw in intake air at atmospheric air pressure and boost it to a higher pressure. The turbocharger compressor may be driven by the rotation of an exhaust turbine, coupled to the compressor by a shaft, the turbine spun by the flow of exhaust gases there-through.

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling door 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23. While a single canister 22 is shown, it will be appreciated that fuel system 18 may include any number of canisters Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated (e.g., canister load is higher than a threshold), hydrocarbons stored in fuel vapor canister 22 may be purged to engine intake 23 by opening canister purge valve 112 and canister vent valve 114. Canister purge valve 112 and canister vent valve 114 may be solenoid valves, or pulse width modulated solenoid valves that are controlled by the control system 14. Canister purge solenoid valve 112 may have constant cross-sectional valve area. Therefore, vapor flow through the solenoid valve may be proportional to the duration of solenoid ON time when the valve is actuated. That is, the vapor flow may be proportional to a pulse width of the signal applied to the solenoid valve for actuation. For example, as the pulse width of the signal increases, the duration of solenoid ON time may increases. Consequently, vapor flow may increase.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and canister purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve 114 may also be used for diagnostic routines. The canister vent valve 114 may be opened during fuel vapor storing operations (for example, during fuel tank refueling and while the engine is not running) so that air, stripped of fuel vapor after having passed through the canister 22, can be pushed out to the atmosphere. Likewise, during purging operations (for example, during canister regeneration and while the engine is running), the canister vent valve 114 may be opened to allow a flow of fresh air to strip the fuel vapors stored in the canister 22.

During canister purging operation, the timing of closing the CVV 114 and the CPV 112 may be adjusted towards the end of the purging operation to hold at least some vacuum in the tank. Specifically, the CVV 114 may be closed before the CPV 112 is closed so that fuel system vacuum is maintained in between purge operations. This allows a subsequent canister purge operation to be initiated with the fuel tank 20 under negative pressure, enabling flow through the canister bed to be the path of least resistance. This may not only achieve increased purging of the canister bed but may also reduce drawing of fuel tank vapors from the fuel tank vapor dome directly into the engine intake, while bypassing the canister bed.

As such, hybrid vehicle system 6 may have reduced engine operation durations due to the vehicle being powered by engine system 8 during some conditions, and by the energy storage device (e.g., a battery) under other conditions. While the reduced engine operation durations reduce overall carbon emissions from the vehicle, they may also lead to insufficient or incomplete purging of fuel vapors from the vehicle's emission control system. In some embodiments, to address this issue, vapor blocking valve 110 (or VBV) may be optionally included in conduit 31 between fuel tank 20 and canister 22. In some embodiments, vapor blocking valve 110 may be a solenoid valve wherein operation of the valve is regulated by adjusting a driving signal (or pulse width) of the dedicated solenoid.

During vehicle storage when the engine is off, VBV 110 may be kept closed to limit the amount of diurnal vapors directed to canister 22 from fuel tank 20 in systems whose fuel tanks are designed to be at a significant pressure difference form atmospheric pressure. The VBV may be kept open in non-pressurized fuel tanks during engine off. During refueling operations, and selected purging conditions, VBV may be opened to direct fuel vapors from the fuel tank 20 to canister 22. By opening the valve during conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows VBV 110 positioned along conduit 31, in alternate embodiments, the isolation valve may be mounted on fuel tank 20. While the vapor blocking valve is said to open to relieve fuel tank over-pressure (e.g., opened when fuel tank pressure is higher than a threshold pressure and below atmospheric pressure), in still other embodiments, fuel tank 20 may also be constructed of material that is able to structurally withstand high fuel tank pressures, such as fuel tank pressures that are higher than the threshold pressure and below atmospheric pressure.

One or more pressure sensors 120 may be coupled to fuel tank 20 for estimating a fuel tank pressure or vacuum level. While the depicted example shows pressure sensor 120 coupled between the fuel tank and VBV 110 along conduit 31, in alternate embodiments, the pressure sensor may be coupled to fuel tank 20. In still other embodiments, a first pressure sensor may be positioned upstream of the vapor blocking valve, while a second pressure sensor is positioned downstream of the vapor blocking valve, to provide an estimate of a pressure difference across the valve.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The purge vapors may be additionally introduced upstream of the compressor, conditionally depending on the vacuum available to draw in the vapors. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake.

An optional canister check valve (not shown) may be included in purge line 28 to prevent intake manifold pressure from flowing gases in the opposite direction of the purge flow. As such, the check valve may be used if the canister purge valve control is not accurately timed or the canister purge valve itself can be forced open by a high intake manifold pressure. An estimate of the manifold absolute pressure (MAP) may be obtained from MAP sensor 118 coupled to intake manifold 44 and communicated with controller 12. Alternatively, MAP may be inferred from alternate engine operating conditions, such as mass air flow (MAF), as measured by a MAF sensor (not shown) coupled to the intake manifold.

Fuel recovery system 7 and fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open vapor blocking valve (VBV) 110 and canister vent valve (CVV) 114 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open vapor blocking valve 110 and canister vent valve 114, while maintaining canister purge valve 112 closed, to depressurize the fuel tank before allowing enabling fuel to be added therein. As such, vapor blocking valve 110 may be kept open during the refueling operation to allow refueling vapors to be stored in the canister. After refueling is completed, the vapor blocking valve and the canister vent valve may be closed.

As yet another example, the fuel system may be operated in a canister purging mode (e.g., after an emission control device light-off temperature has been attained and with the engine running), wherein the controller 12 may open canister purge valve 112 and canister vent valve 114 sequentially, with the canister purge valve opened before the canister vent valve is opened. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister (herein also referred to as the canister load) is below a threshold. During purging, a learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, fuel system pressure sensor 120, fuel system temperature sensor 121, and pressure sensor 129 Other sensors such as additional pressure, temperature, air/fuel ratio, and composition sensors may be coupled to various locations in the vehicle system 6. As another example, the actuators may include fuel injector 66, vapor blocking valve 110, purge valve 112, vent valve 114, vent line valve 124, and throttle 62. The control system 14 may include a controller 12. The controller may receive input data from the various sensors, process the input data, and trigger the actuators in response to the processed input data based on instruction or code programmed therein corresponding to one or more routines. Example control routines are described herein with regard to FIGS. 3 and 4.

During purging, the controller may apply a pulse width modulated signal to the normally closed canister purge solenoid valve in order to open the valve for a desired duration so as to meter fuel vapor flow to the intake manifold (or other vacuum in the engine's air ducting) based on engine operating conditions. A voltage of the signal applied to the purge valve may be based on a system voltage, for example. The system voltage may be based on a battery state of charge, a generator output, and electrical loading. However, the voltage of the signal may experience fluctuations as the battery state of charge, the generator output, and the electrical loading varies from a charged state to a discharge state and vice-versa during engine operation. Further, there may be a delay in opening the solenoid valve. As such, the delay in opening the solenoid valve may be based on the signal voltage. For example, as the system voltage increases, the signal voltage may increase, and consequently, the delay in opening the solenoid valve may decrease. Likewise, there may be a delay in closing the solenoid valve, which may be based on the signal voltage. For example, as the system voltage increases, the signal voltage may increase, and the delay in closing time may decrease.

In order to compensate for the voltage variations related to the system voltage, and the delays in opening and closing the solenoid valve, solenoid offset duration may be determined based on the system voltage, an opening delay duration, and a closing delay duration. If the opening delay duration is greater than the closing delay duration, the offset duration may be added to an effective solenoid ON time to obtain a total solenoid ON duration. As such, the total solenoid ON duration may be a pulse-width of the signal applied to the solenoid valve; the effective solenoid ON duration may be determined based on a desired purge volume, and a purge flow rate; the desired purge volume may be based on a ratio of fuel vapor to air in the gaseous stream exiting the fuel vapor canister, a desired engine fuel rate, an engine fuel rate provided by the injectors, and the desired engine air rate; and the purge flow rate may be based on a pressure ratio of a pressure downstream of the valve to a pressure upstream of the valve. For example, if the pressure ratio is at or below a threshold, purge flow rate may be constant.

In some examples, if the opening delay duration is less than the closing delay duration, the offset duration may be subtracted from the effective solenoid ON time to obtain the total solenoid ON duration.

In this way, by compensating the total solenoid valve ON time based on the voltage-dependent offset duration taking into account the delays in opening and closing the solenoid, improved purge flow control across a wide-voltage range may be achieved.

Turing now to FIG. 2, it illustrates a cross section of an example canister purge solenoid valve 200. Canister purge solenoid valve 200 comprises a valve body 270, valve seat 290, and a valve stem comprising valve plunger 250 and plunger tip 280. When the plunger tip 280 is seated on the surfaces of the valve seat 290, fluid flow (e.g. fuel vapor flow) through the valve from the inlet 202 to the outlet 204 via valve opening 292 is prevented. Valve opening 292 may have a constant cross-sectional area. Therefore, vapor flow through the opening is related to the solenoid ON time when the valve is actuated. For example, as the solenoid ON time increases, vapor flow increases. Canister solenoid valve 200 further comprises a shaft 220 containing a plug 230, return spring 240, and a portion of the valve plunger 250. To operate the valve, current is driven via electrical connections 260 to an electromagnet 210, which then causes the plunger 250 to withdraw into the shaft 220, compressing the return spring 240, and allowing fluid to flow through the valve. The canister solenoid valve 200 is normally closed, when there is no current flowing to the electromagnet 210, wherein the return spring may be compressed beyond its relaxed state when the valve is closed. A needle-type solenoid is shown in FIG. 2 however other types of solenoid valves may also be used. The canister vent valve 114 and vent line valve 124 may also be solenoid valves of the type illustrated in FIG. 2 or may be another type of solenoid valve. The fluid passage may be shaped in such a way that it has the properties of a sonic choke when flowing gases. This allows for the device to provide a constant flow rate for a wide range of vacuum levels at the valve outlet.

Canister purge valve 112 may be a solenoid valve of the same type as canister purge solenoid valve 200. Accordingly, controller 12 may supply current to electrical connections 260 in order to open canister purge valve 112. Canister purge valve 112 may be closed by supplying no current to electrical connections 260. Further, canister purge valve 112 may be configured such that vacuum in fuel system 18, arising for example from intake engine manifold vacuum, aids in closing canister purge valve 112. In other words, negative pressure in the purge line 28 or in the canister 22 may aid in maintaining the valve plunger tip 280 seated on the valve seat 290.

Figure 3:
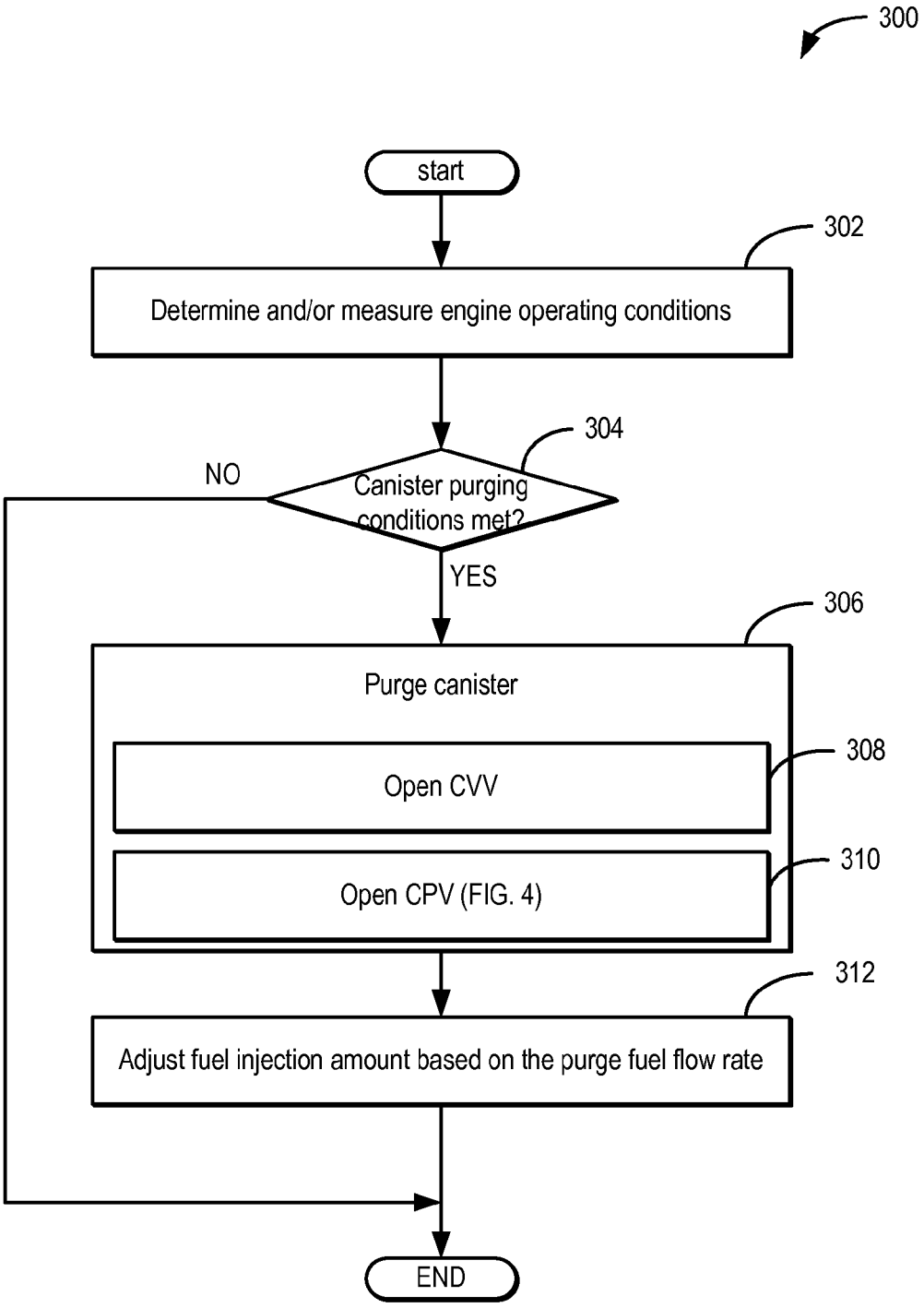
FIG. 3 shows a high level flow chart illustrating an example routine for purging a fuel vapor canister.

Turning to FIG. 3, an example routine 300 is described for purging a fuel vapor canister such as canister 22 at FIG. 1 included in a fuel system such as fuel system 18 at FIG. 1. For example, fuel vapors from a fuel tank may be absorbed by the fuel vapor canister. During purging conditions, the fuel vapors stored in the canister may be delivered to an engine intake manifold via a canister purge valve. The method of FIG. 3 may be stored as executable instructions in non-transitory memory of controller 12 shown in FIG. 1.

At 302, the routine may include determining operating conditions. Operating conditions may include ambient conditions, such as temperature, humidity, and barometric pressure, as well as vehicle conditions, such as engine operating status, fuel level, MAF, MAP, etc. Upon determining operating conditions, the routine may proceed to 304.

At 304, the routine may include confirming purging conditions. Purging conditions may be confirmed based on various engine and vehicle operating parameters, including an amount of hydrocarbons stored in canister 22 being greater than a threshold amount, the temperature of emission control device 70 being greater than a threshold temperature, a temperature of canister 22, fuel temperature, the number of engine starts since the last purge operation (such as the number of starts being greater than a threshold), a duration elapsed since the last purge operation, fuel properties, and various others. Upon confirming purging conditions, the routine may proceed to 306. At 306, the canister may be purged to deliver fuel vapor and air mixture from the canister to the intake manifold. Purging the canister may include, at 308, opening canister vent valve 114 (for example, by energizing a canister vent solenoid) and may further include at 310, opening canister purge valve 112 to purge fuel vapors stored in the canister into the intake manifold. As such, during purging, atmospheric air may be drawn in through the canister vent valve. The air may be utilized to purge the canister of fuel vapors. The purged fuel vapor and air mixture may be delivered to the intake manifold via the canister purge valve. For example, the controller may deliver a pulse-width modulated signal to the canister purge valve in order to open the purge valve for a desired duration. The desired duration may be based on a desired volume of purge, a purge fuel flow rate, and an offset duration. Details of opening the CPV will be further elaborated at FIG. 4. If the purging conditions are not met at 304, the routine may end.

Returning to 306, upon purging the canister, routine 300 may proceed to 312. At 312, routine 300 may include adjusting a fuel injection amount based on an actual canister purge flow rate. In one example, the actual canister purge flow rate may be determined based on a purge flow sensor reading. The purge flow sensor may be positioned in the canister vent passage downstream of the canister purge valve. The fuel injection amount may be adjusted based on the actual purge flow rate to achieve stoichiometry at an exhaust catalyst.

In another example, the purge flow rate may be adjusted based on an engine fuel requirement. For example, the purge fuel flow rate may not exceed 100% of the engine fuel requirement. Further, during idle conditions, the purge flow rate may not exceed 40% of the engine fuel requirement. By adjusting the purge flow rate based on the engine fuel requirements, over fueling may be reduced.

In another example, the purge flow rate may be ratiometrically controlled relative to engine's total fuel needs. For example, the fuel vapor system may be called upon to provide 20% of the engine's fuel need up until the point where the fuel vapor supply reaches its physical constraint at which time its fuel contribution may fall below the target ratio.

In this way, during purging conditions, fuel vapor and air mixture from the canister may be delivered to the intake manifold via the canister purge valve.

Figure 4:
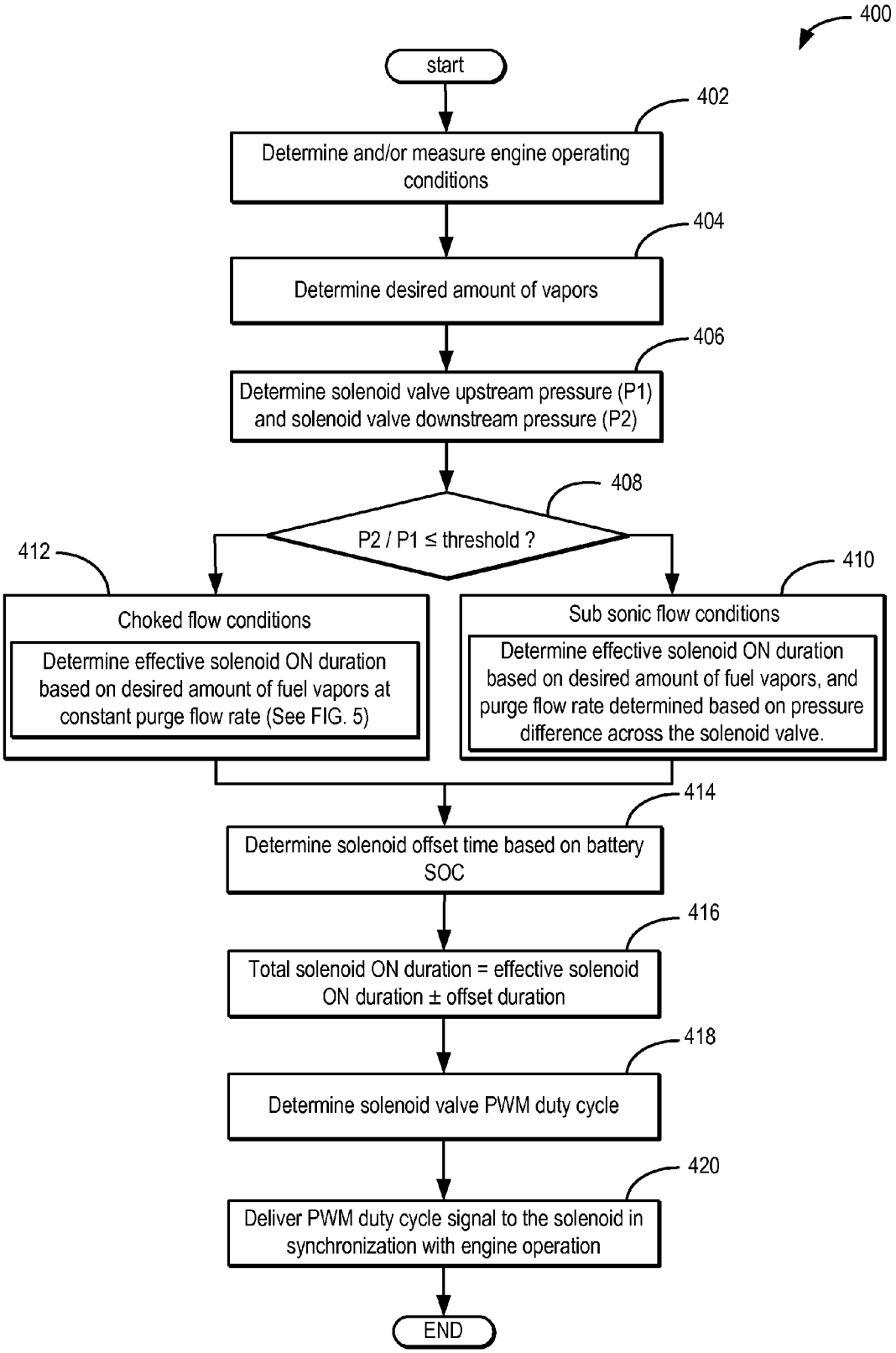
FIG. 4 shows a high level flow chart illustrating an example routine for determining a pulse width of a signal applied to the solenoid canister purge valve during purging.

FIG. 4 shows an example routine 400 for determining a pulse width of a pulse width modulated signal applied to a canister purge valve (e.g. canister purge valve 112 at FIG. 1). The canister purge valve may be driven by the pulse width modulated signal in order to deliver fuel vapors from a fuel vapor canister (e.g., canister 22 at FIG. 1) to the intake manifold. For example, the canister purge valve may be a normally-closed pulse width modulated solenoid valve. A controller may be configured to deliver a series of ON/OFF pulses (a control method herein referred to as pulse width modulation (PWM)) at a voltage to operate the canister purge valve. As such, the voltage may be based on one or more of a vehicle battery state of charges, a generator output, and electrical loads on the vehicle system. For example, as the system voltage increases, the voltage of the pulse width modulated signal delivered to the canister purge valve may increase. Further, in one example, ON-time and OFF-time durations may occur at a fixed period. As such, the period may be a sum of the ON time and the OFF time. For example, in a fixed period condition, the sum of ON time and the OFF time may be 0.1 seconds. In another example, the ON time may be varied while holding the OFF time constant or the OFF time can be held constant while maintaining a constant ON time. In still another example, the period may be operated in synchronism with crankshaft angle. The method of FIG. 4 may be stored as executable instructions in non-transitory memory of controller 12 shown in FIG. 1.

At 402, routine 400 may include estimating and/or measuring engine operating conditions including the battery SOC, an ambient pressure, a MAP, an engine coolant temperature, an exhaust air to fuel ratio, an engine speed, etc. Upon determining engine operating conditions, routine 400 may proceed to 404.

At 404, the routine may include determining a desired volume of fuel vapors that may be delivered from the fuel vapor canister to the intake manifold via the canister purge valve. For example, the desired fuel vapor volume may be based on a ratio of fuel vapor to air exiting the fuel vapor canister, a desired engine fuel rate, an actual engine fuel rate, and a desired engine air rate. In one example, the desired volume of vapors may be based on an engine fuel requirement including fuel injected by the fuel injectors and the fuel vapors from the canister. For example, the desired volume of vapors may be determined based on a condition that the volume of vapors may not exceed 100 percent of the total fuel requirement. Further, during idle conditions, the desired volume of fuel vapors may be determined based on the fuel vapor volume not exceeding 40% of the total fuel requirement. In another example, the desired volume of vapors may be based on ratiometrically controlling the desired volume of fuel vapors such that the proportion of fuel vapors is a fraction of the total fuel requirement.

Next, at 406, the routine may include determining a solenoid upstream pressure P1 and a solenoid downstream pressure P2. The pressure P1 may be determined upstream of the solenoid valve and the pressure P2 may be determined downstream of the solenoid valve. For example, during purging conditions, P1 may be an ambient pressure, and P2 may be a manifold absolute pressure (MAP). As such, MAP may be determined based on a MAP sensor reading.

Upon determining the upstream and the downstream pressures P1 and P2, the routine may proceed to 408. At 408, the routine may determine if a downstream to upstream pressure ratio (P2/P1) is less than or equal to a threshold pressure ratio. For example, the threshold pressure ratio may be based on a critical pressure ratio required for purge flow rate to transition from sonic flow (also herein referred to as "choked flow") to sub-sonic flow.

If the answer at 408 is yes, the routine may proceed to 412. At 412, the routine may include determining an effective solenoid ON duration based on a desired amount of fuel vapors, wherein the fuel vapor flow rate is constant. For example, when the downstream to upstream pressure ratio across the solenoid valve is at or below the threshold pressure ratio, the flow may be "choked". During choked flow conditions, the flow rate of the fuel vapors through the solenoid valve may be constant. In other words, during choked flow conditions, the flow rate may be independent of pressure fluctuations downstream of the solenoid valve. Therefore, during choked flow conditions, fuel vapor flow rate may vary linearly with respect to the effective solenoid ON time. For example, as the effective solenoid ON time increases, the fuel vapor flow rate (that is, volume of fuel vapors per pulse width duration) may increase. Consequently, the volume of fuel vapors flowing through the solenoid valve may increase. An example of the canister purge valve flow characteristics during choked conditions will be elaborated with respect to FIG. 5.

Returning to 408, if the downstream to upstream pressure ratio across the solenoid valve is greater than the threshold pressure ratio, the fuel vapor flow through the valve may be occurring at subsonic conditions. During subsonic conditions, the fuel vapor flow rate may not be a constant, and may be based on the upstream and the downstream pressure conditions. Therefore, during subsonic conditions, the effective solenoid ON duration may be based on the desired amount of fuel vapors and the fuel vapor flow rate, wherein the fuel vapor flow rate is based on the upstream and the downstream pressure.

In one example, during subsonic flow conditions, when the flow rate is below a threshold flow rate, the controller may be adjusted to close the canister purge valve.

In still another example, when a fuel vapor to air ratio in the canister is below a threshold, the solenoid valve may be operated to provide maximum purge rate in order to warm the canister and purge the remaining fuel vapor from it.

Upon determining the effective solenoid ON duration based on flow conditions, the routine may proceed to 414. At 414, the routine may include determining a solenoid offset duration based on a voltage supplied to the valve. The voltage supplied may be a vehicle system voltage. As such, the vehicle voltage may vary as the generator, electrical loads, and the battery state of charge vary between levels of discharge and charge. Accordingly, the solenoid offset duration may vary based on the system voltage. For example, as the system voltage increases, the offset duration may decrease.

Next, at 416, the routine may include determining a total solenoid ON duration. As such, the total solenoid ON duration may be a pulse width of the pulse width modulated signal that may be applied to the solenoid valve in order to actuate the valve. There may be a delay in opening and/or closing the solenoid valve (that is, delayed opening response time and/or delayed closing response time). The opening and closing response times may be dynamic response times varying with respect to system voltage. For example, as the system voltage increases, the opening/closing response time may decrease. In order to compensate for the fluctuations in the system voltage, and the delayed response times, the total solenoid ON duration may be based on the effective solenoid ON time and the offset voltage. For example, the solenoid offset duration may be added to the effective solenoid ON duration (determined at 408) or subtracted from the effective solenoid ON duration to obtain the total solenoid ON duration. Specifically, if the opening response time is greater than the closing response time, the offset duration may be added to the effective solenoid ON time to obtain the total solenoid ON duration; and if the opening time is less than the closing time, the offset duration may be subtracted from the effective solenoid duration to obtain the total solenoid ON duration.

In one example, if the solenoid opening response time is equal to the solenoid closing response time, the effective solenoid ON time may be the total solenoid ON time. That is, if the solenoid opening and closing durations are equal, the effective solenoid ON time and the total solenoid ON time may be the same.

Upon determining the total solenoid ON duration, the routine may proceed to 418. At 418, the routine may include determining a duty cycle of a pulse width modulated signal that may be delivered to the solenoid valve by the controller to operate the valve. For example, a duty cycle of the pulse width modulated signal may be a percentage of ratio of a pulse width of a pulse to a period of the pulse. As discussed above, pulse width may be a duration of time the signal is ON. That is, the pulse width may be the total solenoid ON time. The term "period" may describe a time beginning with an ON pulse and ending immediately before the next ON pulse.

Next, at 420, the PWM signal may be applied to the solenoid in synchronization with engine operation. For example, the pulses may be delivered to the canister purge valve such that the fuel vapors are injected at the same frequency as the cylinder events. As such, the canister purge valve may be considered as a central gaseous injector injecting fuel vapors during cylinder events (e.g. a cylinder intake event). In one example, the beginning of the ON state of each pulse may be adjusted to coincide with an intake stroke when a piston of a cylinder descends from top dead center to bottom dead center. By synchronizing pulse duration and pulse frequency with engine operation, the canister purge valve closing frequency noise may be masked by the engine noise at the firing frequency. Further, cylinder-to-cylinder distribution of fuel vapors may be improved. For example, when purging is synchronized with engine operation, the engine cylinders may be sampling the fuel vapors at the fuel vapor sampling rate (or harmonic of the fuel vapor sampling rate). As a result, the two frequencies (that is, the fuel vapor purge frequency and the cylinder firing frequency) may be synchronized. Consequently, mal-distribution of fuel vapors may be reduced. As a result, fueling noise may be reduced.

In some examples, there may be as many canisters as the number of cylinders, each canister delivering fuel vapors to each cylinder via a corresponding canister purge valve. For example, fuel vapors from a first canister may be delivered to a first cylinder in synchronization with operation of the first cylinder via a first canister purge valve.

In this way, the duty cycle of the pulse width modulated signal applied to the canister purge valve may be compensated for variations in the input voltage source and delays in the opening and closing response times of the valve. Further, by synchronizing engine operation with the signal, fueling noise may be reduced and fuel vapor distribution may be improved.

As such, for the canister purge solenoid valve utilized in the vehicle system as disclosed herein, the sonic to sub-sonic flow transition may occur at pressure ratios of 0.80 to 0.85, which is higher than typical for solenoid valve gaseous injectors. As a result, the sonic operation region for a canister purge solenoid valve is greater than the sonic operation region for the gaseous injector, thereby providing greater flow controllability and predictability. Further, by compensating for variations in input voltage and delays in opening and closing response times of the valve, improved purge flow control in a wide-voltage range may be achieved.

Turning to FIG. 5, a graph illustrating a canister purge valve injection volume characteristics during choked flow conditions is shown. Choked flow conditions may include a solenoid valve downstream pressure to a solenoid valve upstream pressure ratio below a threshold pressure ratio. For example, during purging conditions, choked flow may occur when a manifold absolute pressure to ambient pressure ratio decreases below a threshold pressure ratio. As such, during choked flow conditions, fuel vapor flow rate may be a constant.

The graph illustrates flow per pulse versus pulse duration. The pulse duration may be a duration of pulse ON time. The Y axis represents flow per pulse in liters and the X axis represents pulse duration in milliseconds. Trace 502 represents change in fuel vapor flow with respect to the pulse duration at 4.5 milliseconds offset. As illustrated, during choked flow conditions, the flow volume per pulse may be in a linear relationship with respect to the pulse duration. That is, during choked flow conditions, flow volume per pulse may be a function of pulse duration increasing linearly with increase in pulse duration, and may not be dependent on a pressure difference across the solenoid valve.

In the illustrated example, the relationship between flow per pulse and pulse duration at an offset duration of 4.5 milliseconds is shown. As discussed above, the offset duration may be determined based on system voltage. Further, in the illustrated example, an opening response time is greater than a closing response time. Consequently, the offset duration may be positive.

As such, the relationship between flow per pulse and pulse duration may be substantially affine. However, when the on-time is very near the offset time or when the off time is very small, the relationship may be non-affine because the solenoid valve did not fully open or fully close.

In one example, the canister purge valve injection volume characteristics as illustrated above may be stored in a look-up table. The look-up table may be stored in non-transitory memory of controller 12 shown in FIG. 1. For example, the look-up table may include, for a given offset duration, a pulse ON duration that may be utilized to achieve a desired flow volume per pulse. By utilizing the look-up table, the pulse duration for the desired flow volume may be obtained. One can see that this line is substantially affine. When the on-time is very near the offset time or when the off time is very small, the characteristic becomes non-affine because of the injector did not fully open or fully close.

In order to determine the pulse duration, a desired flow volume per pulse may be determined based on engine operating conditions. In one example, the desired flow volume per pulse may be based on an engine fuel requirement including fuel injected by the fuel injectors and the fuel vapors from the canister. For example, the desired flow volume per pulse may be determined based on a condition that the volume of vapors may not exceed 100 percent of the total fuel requirement. Further, during idle conditions, the desired flow volume per pulse may be determined based on the fuel vapor volume not exceeding 40% of the total fuel requirement. In another example, the desired flow volume per pulse may be based on ratiometrically controlling the desired flow volume per pulse vapors such that the proportion of fuel vapors is a fraction of the total fuel requirement.

Further, an offset duration may be determined. For example, if the opening response time is greater than the closing response time, the offset duration may be positive. However, if the opening response time is less than the closing response time, the offset duration may be negative. As such, the offset duration may be based on system voltage. For example, as the system voltage increases, the response time may decrease. Consequently, the offset duration may increase.

Turning to FIG. 6, an example change in duty cycle of a rectangular pulse waveform based on an offset duration is shown. The waveform may be applied to a solenoid valve (e.g., canister purge solenoid valve 112 at FIGS. 1 and 2) in order to regulate opening and closing of the solenoid valve. The offset duration may be based on a system voltage, and further based on an opening response time and a closing response time. The opening response time may be a duration of time required for the solenoid to move from a closed state to an open state. The closing response time may be a duration of time required for the solenoid to move from an open state to a closed state. Vertical markers at times t0-t6 represent beginning of an ON state for each pulse.

The first plot from the top of FIG. 6 represents voltage (V) versus time. The X-axis represents time and the Y-axis represents voltage. Trace 602 represents a first waveform without offset. As such, a duty cycle of first waveform 602 may be a ratio of a solenoid ON duration d1 to a pulse period (t1-t2). The solenoid ON duration may be determined based on a desired volume of purge and a flow-rate of the purge. Details of determination of solenoid ON duration are described at FIGS. 3 and 4.

The second plot from the top of FIG. 6 represents voltage (V) versus time. The X-axis represents time and the Y-axis represents voltage. Trace 604 represents a second waveform with offset when the opening response time is greater than the closing response time. As such, a duty cycle of second waveform 604 may be a ratio of a solenoid ON duration d2 to a pulse period (t1-t2). The solenoid ON duration may be determined based on a desired volume of purge, a flow-rate of the purge, and an offset duration. Details of determination of solenoid ON duration are described at FIGS. 3 and 4.

The third plot from the top of FIG. 6 represents voltage (V) versus time. The X-axis represents time and the Y-axis represents voltage. Trace 606 represents a third waveform with offset when the opening response time is less than the closing response time. As such, a duty cycle of third waveform 606 may be a ratio of a solenoid ON duration d2 to a pulse period (t1-t2). The solenoid ON duration may be determined based on a desired volume of purge, a flow-rate of the purge, and an offset duration. Details of determination of solenoid ON duration are described at FIGS. 3 and 4.

As such, when the opening response time is greater than the closing response time, the offset duration may be added to the solenoid ON duration. Consequently, the total solenoid ON duration may be greater than the effective solenoid ON duration. However, when the opening response time is less than the closing response time, the offset duration may be subtracted from the solenoid ON duration. Consequently, the total solenoid ON duration may be less than the solenoid ON duration. As a result, the solenoid ON duration d2 may be greater than the solenoid ON duration d3. In other words, for a given desired fuel flow rate, the pulse width of the duty cycle of the waveform applied to the solenoid valve when the opening response time of the solenoid valve is greater than the closing response time (604) may be greater than the pulse width of the duty cycle of the waveform applied to the solenoid valve when the opening response time is less than the closing response time (606).

Further, the opening of the solenoid valve may be adjusted based on an engine crankshaft position. The engine crankshaft position may be determined based on an engine crankshaft position sensor. For example, the total solenoid ON event may be adjusted to coincide with a cylinder firing event in order to improve air/fuel distribution. In one example, the beginning of the ON state of each pulse may be adjusted to coincide with an intake stroke when a piston of a cylinder descends from top dead center to bottom dead center. As such, when the beginning of the ON state coincides with the intake stroke, the vaporous fuel may be injected at a "sample rate" of the intake stroke. Synchronizing vaporous fuel injection with engine intake may yield improved cylinder-to-cylinder distribution even if the injection occurs significantly upstream of the cylinder. Injecting at double, triple, et cetera the sample rate of the intake stroke may also improve distribution of fuel vapors).

In this way, the duty cycle of the signal applied to the solenoid valve may be adjusted based on the offset duration (which is determined based on the system voltage), the opening response time and the closing response time. By taking into account the system voltage and the response times, the solenoid valve may be operated in a wide-voltage range.

Turning to FIG. 7, it shows operating sequence 700 depicting an example change in solenoid ON duration based on a system voltage. The sequence of FIG. 5 may be provided by executing instructions in the system of FIG. 1 according to the method of FIG. 4. Vertical markers at times t0-t3 represent times of interest during the sequence.

The first plot from the top of FIG. 7 represents the system voltage versus time. The Y axis represents system voltage and the system voltage increases in the direction of Y axis arrow. The X axis represents time and time increases from the left side of the plot to the right side of the plot.

The second plot from the top of FIG. 7 represents an offset duration versus time. The Y axis represents the offset duration and the offset duration increases in the direction of Y axis arrow. The X axis represents time and time increases from the left side of the plot to the right side of the plot.

The third plot from the top of FIG. 7 represents a solenoid ON duration versus time. The Y axis represents the solenoid ON duration and the solenoid ON duration increases in the direction of Y axis arrow. The X axis represents time and time increases from the left side of the plot to the right side of the plot. Trace 704 represents change in solenoid valve ON duration for a solenoid valve if a solenoid opening response time is greater than a solenoid closing response time. Trace 705 represents change in solenoid valve ON duration for the solenoid valve if the solenoid opening time is less than the solenoid closing time.

The fourth plot from the top of FIG. 7 represents purge flow rate versus time. The Y axis represents the purge flow rate and the flow rate increase in the direction of Y axis arrow. The X axis represents time and time increases from the left side of the plot to the right side of the plot. Trace 706 represents flow rate during choked conditions. That is, during choked conditions, the flow rate is constant.

The fifth plot from the top of FIG. 7 presents a desired purge volume versus time. The Y axis represents the desired purge volume and the desired purge volume increases in the direction of Y axis arrow. The X axis represents time and time increases from the left side of the plot to the right side of the plot.

As such, the opening response time may be based on a first duration to develop a magnetic flux, and a second duration for a plunger (e.g., plunger 250 at FIG. 2) to move to a desired open position. The closing response time may be based on a third duration to dissipate the magnetic flux, and a fourth duration for the plunger to move to a desired closed position. The system voltage may be based on a battery state of charge, a generator output, and electrical load of the system.

Prior to time t1, the system voltage may remain constant. The system voltage may be utilized to determine the offset duration (703). Consequently, the offset duration (703) may remain constant. The offset duration may be added or subtracted (based on the solenoid opening and closing response times) from an effective solenoid ON duration (determined based on purge flow rate and desired purge volume) to obtain a total solenoid ON duration. Due to constant offset duration, the total solenoid ON duration (704 and 705) may remain constant. For example, at time points prior to t1, the duration of each pulse of the waveform applied to a solenoid valve may be equal. That is, the pulse width of each pulse may be equal. Consequently, the duty cycle of each pulse prior to t1 may be equal. However, if the opening response time is greater than the closing response time, the offset duration may be added to the effective solenoid ON duration. Whereas, if the opening response time is less than the closing response time the offset duration may be subtracted from the effective ON duration. Consequently, at a given input voltage, the total solenoid ON duration if the opening response time is greater than the closing response time (704) may be greater than the total solenoid ON duration if the opening response time is less than the closing response time (705).

Further, the purge flow rate may be constant. For example, the solenoid valve may be operating in choked conditions and consequently, the flow rate may be constant. For example, flow through a solenoid valve may be choked when a downstream pressure to upstream pressure ratio is less than or equal to a threshold pressure ratio. The threshold pressure ratio maybe a critical pressure ratio below which, flow through the valve may be choked. During choked conditions, the purge flow rate may be constant, independent of pressure variations downstream of the valve. The desired volume of purge may also remain constant.

Between times t1 and t2, the system voltage (702) may increase. As a result, the offset duration (703) may decrease. As discussed above, if the solenoid opening response time is greater than the solenoid closing response time, the offset duration may be added to the effective solenoid ON duration, and if the solenoid opening response time is less than the solenoid closing response time, the offset duration may be subtracted from the effective solenoid ON duration. As a result, if the opening response time is greater than the closing response time, the total solenoid ON duration may decrease with increasing system voltage. In contrast, if the opening response time is less than the closing response time, the total solenoid ON duration may increase with increasing system voltage. Further, as discussed above, the purge flow rate and the desired purge volume may remain constant.

Next, between times t2 and t3, the system voltage may decrease (702). Consequently, the offset duration may increase (703). If the opening response time is greater than the closing response time for the solenoid valve, the offset duration may be added to the effective solenoid ON duration. As a result, the total solenoid ON duration may increase with decreasing state of charge (704). However, if the opening time is less than the closing time, the offset duration may be subtracted from the effective solenoid ON duration. As a result, the total solenoid ON duration may decrease with decreasing state of charge (705). Further, the purge flow rate may remain constant (choked conditions) and the desired purge volume may remain constant.

At t3 and beyond, as discussed with respect to times prior to t1, the state of charge may remain constant. The flow rate and the desired volume may be constant. Consequently, the offset duration, and the solenoid ON duration may be constant.

In this way, by adjusting the solenoid ON duration based on the system voltage, and based on the opening and closing response times, more accurate flow control of fuel vapors flowing through the solenoid valve may be achieved.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine comprising:

during fuel vapor purging, applying a signal to an electronically controllable solenoid valve coupling a fuel vapor canister and an intake manifold of the engine in synchronization with a crankshaft position;

a pulse width of the signal adjusted differently, based on an offset duration determined based on an instantaneous system voltage, depending on a comparison of an opening response time of the solenoid valve to a closing response time of the solenoid valve.

2. The method of claim 1, wherein the pulse width is further based on a solenoid effective ON duration determined based on a desired purge volume and a purge flow rate.

3. The method of claim 2, wherein the opening response time is a duration for the solenoid valve to move from a closed position to an open position, and the closing response time is a duration for the solenoid valve to move from the open position to the closed position.

4. The method of claim 2, further comprising, when an absolute value of a difference between the opening response time and the closing response time is greater than a threshold difference, if the opening response time is greater than the closing response time, adding the offset duration to the effective ON duration.

5. The method of claim 2, further comprising, when an absolute value of a difference between the opening response time and the closing response time is greater than a threshold difference, if the opening response time is less than the closing response time, subtracting the offset duration from the effective ON duration.

6. The method of claim 2, further comprising, when an absolute value of a difference between the opening response time and the closing response time is less than a threshold difference, setting the offset duration to zero.

7. The method of claim 2, further comprising decreasing the offset duration as the system voltage increases.

8. The method of claim 2, wherein the purge flow rate is a constant if a pressure ratio between a manifold absolute pressure and an atmospheric pressure is less than a threshold pressure ratio.

9. The method of claim 2, wherein the purge flow rate is based on a manifold absolute pressure and an atmospheric pressure if a pressure ratio of the manifold absolute pressure to the atmospheric pressure is greater than a threshold pressure ratio.

10. The method of claim 1, further comprising adjusting an engine air-to-fuel ratio based on a ratio of fuel vapor to air exiting the fuel vapor canister.

11. The method of claim 2, wherein the desired purge volume is based on a ratio of fuel vapor to air exiting the fuel vapor canister, a desired engine fuel rate, an actual engine fuel rate, and a desired engine air rate.

12. A method for an engine including a solenoid canister purge valve coupling a fuel vapor canister and an intake manifold of the engine comprising:

during a first condition, decreasing a pulse width of a signal applied to the solenoid valve based on a desired purge volume, a first purge flow rate, and a decreased offset duration;

during a second condition, increasing the pulse width of the signal based on the desired purge volume, a second purge flow rate, and the decreased offset duration.

13. The method of claim 12, wherein the first condition includes a pressure ratio between a manifold absolute pressure and an atmospheric pressure less than a threshold ratio; wherein, the second condition includes the pressure ratio between the manifold absolute pressure and the atmospheric pressure greater than the threshold ratio; wherein, the first purge flow rate is independent of the manifold absolute pressure; wherein, the second purge flow rate is based on a pressure difference between the manifold absolute pressure and the atmospheric pressure; and wherein the decreased offset duration is based on an increased system voltage.

14. The method of claim 12, further comprising determining a duty cycle of the signal based on the pulse width and delivering the signal to the valve in synchronization with an engine crankshaft position.

15. The method of claim 13, wherein the desired purge volume is based on a ratio of fuel vapor to air exiting the fuel vapor canister, a desired engine fuel rate, an actual engine fuel rate, and a desired engine air rate.

16. The method of claim 12, wherein the first condition further includes an opening response time greater than a closing response time, and wherein the second condition further includes the opening response time less than the closing response time.

17. The system of claim 16, wherein at a given system voltage, the pulse width of the signal when the opening time is greater than the closing time, is greater than the pulse width of the signal when the opening time is less than the closing time.

18. An engine system comprising:

an engine including an intake manifold;

a fuel tank;

a fuel vapor canister coupled to the fuel tank;

a canister purge valve coupled between the intake manifold and the canister for injecting stored fuel vapors from the canister to the intake; and a controller with computer readable instructions for:

during purging conditions, determining a first duty cycle of a signal delivered to the valve for purging the canister based on a desired purge volume and a purge flow rate;

determining an offset duration based on an instantaneous system voltage;

adding the offset duration to the first duty cycle to obtain a second duty cycle of the signal if a solenoid opening response time is greater than a solenoid closing response time;

subtracting the offset duration from the first duty cycle to obtain a third duty cycle of the signal if the solenoid opening response time is less than the solenoid closing response time; and delivering the signal in synchronization with an engine crankshaft position.

19. The system of claim 18, wherein the purge flow rate is a constant if a pressure ratio between a manifold absolute pressure and an atmospheric pressure is less than a threshold pressure ratio.

20. The method of claim 19, wherein the purge flow rate is based on the manifold absolute pressure and the atmospheric pressure if the pressure ratio between the manifold absolute pressure and the atmospheric pressure is greater than the threshold pressure ratio.

* * * * *